US006237338B1

(12) United States Patent
Magoshi et al.

(10) Patent No.: US 6,237,338 B1
(45) Date of Patent: May 29, 2001

(54) FLEXIBLE INLET TUBE FOR A HIGH AND INTERMEDIATE PRESSURE STEAM TURBINE

(75) Inventors: Ryotaro Magoshi; Takashi Nakano, both of Takasago (JP)

(73) Assignee: Mitsubishi Heavy Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/428,665

(22) Filed: Oct. 28, 1999

(51) Int. Cl.[7] ..... F01K 13/02

(52) U.S. Cl. ..... 60/646; 60/657; 415/134; 415/135

(58) Field of Search ..... 60/657, 643, 670, 60/679, 646; 415/134, 136, 135

(56) References Cited

U.S. PATENT DOCUMENTS 2,808,226 * 10/1957 Hacker et al. ..... 415/135
2,879,029 * 3/1959 Wienola ..... 415/135
3,592,557 * 7/1971 Haas ..... 415/136
3,746,463 * 7/1973 Stock et al. ..... 415/136
4,697,983 10/1987 Yamaguchi .
4,772,178 9/1988 Miller .
5,037,270 8/1991 Bangel et al. .

FOREIGN PATENT DOCUMENTS 61-079804 4/1986 (JP) .

* cited by examiner

*Primary Examiner*—Hoang Nguyen
(74) *Attorney, Agent, or Firm*—Alston & Bird LLP

(57) ABSTRACT

The present invention relates to a flexible inlet tube for a high and intermediate pressure steam turbine. A reheat steam inlet tube is constructed integrally with a casing. The inlet tube has a double tube portion to form an annular groove. The lower end of the double tube portion has an expanded diameter, and a vertical sliding motion can be accomplished between the expanded diameter portion and a flange fixed to a thermal shield, so that thermal elongation is absorbed. Low-temperature steam flows into the annular groove from an in-casing space through a hole, circulates in the annular groove, and flows out to a steam passage in an intermediate pressure turbine section, by which the interior of the annular groove is cooled, so that a temperature rise of the casing can be prevented.

6 Claims, 3 Drawing Sheets

FLEXIBLE INLET TUBE FOR A HIGH AND INTERMEDIATE PRESSURE STEAM TURBINE

FIELD OF THE INVENTION AND RELATED ART STATEMENT

The present invention relates to a flexible inlet tube for a high and intermediate pressure steam turbine. More particularly, it relates to a flexible inlet tube for a high and intermediate pressure steam turbine, in which an inlet tube for reheat steam has a flexible construction of a double tube and is also cooled by steam to restrain the thermal effect on a casing.

FIG. 3 is a sectional view of a steam inlet portion of a high and intermediate pressure steam turbine relating to the present invention. In FIG. 3, reference numeral 11 denotes a casing for covering the whole turbine, and 12 denotes a rotor. Both ends of the casing 11 are sealed by a seal portion 13. Reference numeral 14 denotes a main steam inlet tube. A tip end portion 14*a* of the main steam inlet tube 14 is installed by a weld 22, and a base portion thereof is fixed to or formed integrally with the casing 11. The main steam inlet tube 14 introduces main steam into the casing 11. Reference numeral 15 denotes a reheat steam inlet tube. The reheat steam inlet tube 15 is formed integrally with the casing 11, and introduces reheat steam into the casing 11.

Reference numeral 16 denotes a high pressure turbine stationary portion, and 17 denotes a high pressure turbine section. Although not shown in the figure, in the high pressure turbine section 17, rotor blades installed to the rotor 12 and stator blades fixed to the high pressure stationary portion 16 are arranged in a multi-stage mode, forming a steam passage. Reference numeral 18 denotes an intermediate turbine stationary portion, and 19 denotes an intermediate pressure turbine section. In the intermediate pressure turbine section 19, as in the high pressure turbine section 17, rotor blades installed to the rotor 12 and stator blades fixed to the intermediate pressure stationary portion 18 are arranged in a multi-stage mode, forming a steam passage. A seal ring 20 partitions a turbine section into the high pressure turbine section 17 and the intermediate pressure turbine section 19 by providing a seal around the rotor 12. A thermal shield 21 prevents a base portion of the reheat steam inlet tube 15 of the casing 11 from being heated by heat from steam flowing into the steam passage in the intermediate pressure turbine section 19. Also, the thermal shield 21, which has an opening 24, introduces reheat steam 31 into the steam passage. Reference numeral 23 denotes a space provided between the casing 11 and the high pressure turbine stationary portion 16, and 25 denotes a nozzle chamber for main steam 30 introduced through the main steam inlet tube 14.

In the high and intermediate pressure steam turbine configured as described above, the high-pressure main steam 30, which is introduced into the casing 11 through the main steam inlet tube 14, enters the steam passage in the high pressure turbine section 17 through nozzles of the nozzle chamber 25, and flows to an exhaust system (not shown) after passing between the rotor blades and the stator blades, by which the rotor 12 is driven. Further, the reheat steam 31, which is introduced into the casing 11 through the reheat steam inlet tube 15, enters the steam passage in the intermediate pressure turbine section 19 through the opening 24 in the thermal shield 21, and flows to the exhaust system after passing between the rotor blades and the stator blades, by which the rotor 12 is driven.

For the aforementioned reheat steam inlet tube 15, which is constructed integrally with the casing 11 and is provided with the thermal shield 21, a tube side wall thereof is heated by the introduced reheat steam 31, so that the temperature of the base portion of the inlet tube 15, that is, the temperature of the tube base is increased, and the casing 11 constructed integrally with this tube base is also heated by this increase in temperature. Therefore, a high-strength material capable of withstanding a thermal stress at high temperatures is used.

As described above, in the high and intermediate pressure steam turbine relating to the present invention, since the reheat steam inlet tube 15 is constructed integrally with the casing 11, the reheat steam 31 directly heats the integrally constructed casing 11 through the tube base of the reheat steam inlet tube 15. Therefore, as the temperature of the reheat steam 31 rises, the temperature of the tube base increases, by which a high thermal stress is given to the casing 11. For this reason, as the material for the casing 11, a 12Cr material that has a high strength and contains much chromium must be used, which results in a high cost.

OBJECT AND SUMMARY OF THE INVENTION

An object of the present invention is to improve a construction of a reheat steam inlet tube for a high and intermediate pressure steam turbine to provide a flexible inlet tube which has a construction capable of absorbing a change caused by heat and a construction capable of performing steam cooling to restrain a temperature rise of a casing constructed integrally with the inlet tube, and can use a material equivalent to an inexpensive low alloy steel as the material for the casing.

To achieve the above object, the present invention provides the following means of (1) and (2). (1) In a flexible inlet tube for a high and intermediate pressure steam turbine, which is used for a high and intermediate pressure steam turbine in which there are provided a main steam inlet tube for introducing main steam into a high pressure turbine section in a casing and a reheat steam inlet tube for introducing reheat steam into an intermediate pressure turbine section in the casing, and a thermal shield, which has an opening for introducing the reheat steam and thermally shields a surrounding portion at the lower end of the reheat steam inlet tube from the steam in the casing, is provided at the lower end of the reheat steam inlet tube, the flexible inlet tube is characterized in that the reheat steam inlet tube is constructed as a double tube formed with an annular groove around an inner tube of the reheat steam inlet tube, and there are provided a cylindrical member one end of which slidably overlaps with the lower end portion of the inner tube of the double tube and the other end of which is fixed to the periphery of an opening of the thermal shield and a seal ring interposed between the cylindrical member and the lower end portion of the inner tube of the reheat steam inlet tube. (2) In the invention of the above means (1), steam having a temperature lower than that of the reheat steam is introduced into the annular groove of the reheat steam inlet tube and is circulated in the annular groove.

In the means (1) of the present invention, the reheat steam inlet tube is constructed as a double tube, and has the annular groove therein. Also, the lower end portion of the inner tube of the double tube overlaps with the cylindrical member fixed to the thermal shield, and the seal ring is interposed therebetween, by which a vertical sliding motion can be accomplished, and the reheat steam flowing into the inlet tube can be prevented from flowing into the annular groove. The reheat steam flowing into the inlet tube passes through the inside of the double tube construction, and the periphery is isolated by the annular groove, so that heat is prevented from being transmitted from the peripheral wall surface to the casing wall. Also, even if thermal elongation of a double tube portion is developed by heating, the double tube portion is slidable with respect to the cylindrical member via the seal ring, so that the thermal elongation can be absorbed easily.

Therefore, in the flexible inlet tube of the means (1) of the present invention, a temperature rise on the casing side caused by the reheat steam is made less liable to be conveyed to the surroundings by the annular groove, and thermal elongation is absorbed. Therefore, as the material for the casing, an inexpensive material such as 2(½)Cr steel can be used in place of an expensive 12Cr material having a high strength.

In the means (2) of the present invention, for example, a space in the casing and one end of the annular groove are caused to communicate with each other to cause steam having a temperature lower than that of the reheat steam to flow into the annular groove so that circulation of steam is produced in the annular groove, and the hole is formed in the thermal shield closing the annular groove, for example, to provide communication between the annular groove and the inside steam passage and to cause the steam to flow out, by which the annular groove can be cooled. Therefore, the cooling effect of the above means (1) is made more reliable.

In a flexible inlet tube for a high and intermediate pressure steam turbine in accordance with the means (1) of the present invention, which is used for a high and intermediate pressure steam turbine in which there are provided a main steam inlet tube for introducing main steam into a high pressure turbine section in a casing and a reheat steam inlet tube for introducing reheat steam into an intermediate pressure turbine section in the casing, and a thermal shield, which has an opening for introducing the reheat steam and thermally shields a surrounding portion at the lower end of the reheat steam inlet tube from the steam in the casing, is provided at the lower end of the reheat steam inlet tube, the flexible inlet tube is characterized in that the reheat steam inlet tube is constructed as a double tube formed with an annular groove around an inner tube of the reheat steam inlet tube, and there are provided a cylindrical member one end of which slidably overlaps with the lower end portion of the inner tube of the double tube and the other end of which is fixed to the periphery of an opening of the thermal shield and a seal ring interposed between the cylindrical member and the lower end portion of the inner tube of the reheat steam inlet tube. By this configuration, the reheat steam flowing into the inlet tube passes through the interior of the inlet tube having a double tube construction, and the periphery is isolated by the annular groove so that heat is less liable to be transmitted to the casing wall. Therefore, even if thermal elongation of the double tube portion is developed by heating, the change of thermal elongation can be absorbed easily by a sliding motion accomplished between the double tube portion and the cylindrical member via the seal ring. For this reason, as the material for the casing, an inexpensive material containing less chromium can be used in place of the conventionally used material containing much chromium that is a high-strength material.

According to the means (2) of the present invention, in the invention of the above means (1), steam having a temperature lower than that of the reheat steam is introduced into the annular groove of the reheat steam inlet tube and is circulated in the annular groove. By this configuration, the steam having a temperature lower than that of the reheat steam circulates in the annular groove, whereby the interior of the annular groove is cooled. Therefore, the cooling effect of the above means (1) is made more reliable.

DETAILED DESCRIPTION OF PREFERRED EMBODIMENTS

Figure 1:
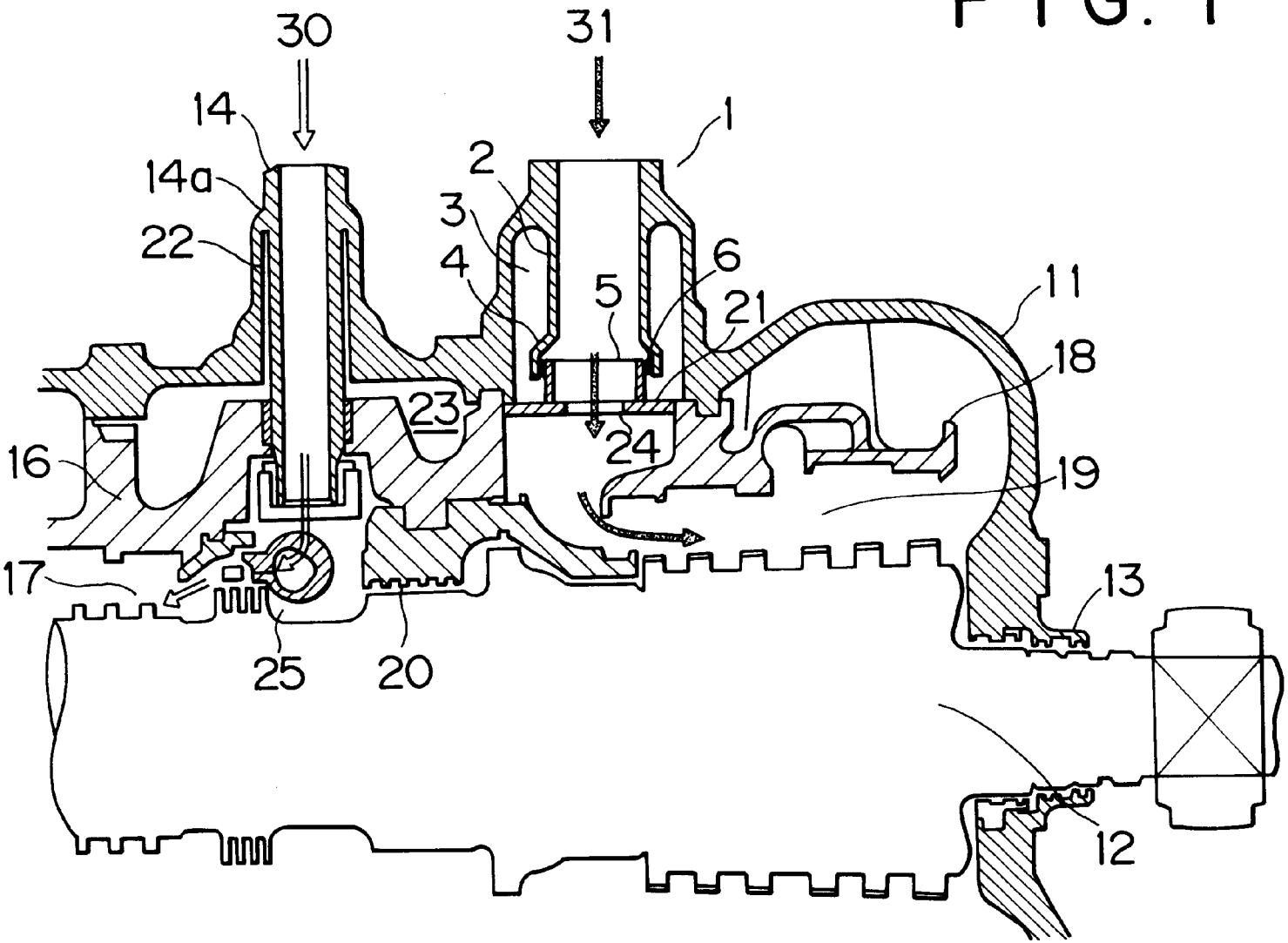
FIG. 1 is a sectional view showing the vicinity of a flexible inlet tube for a high and intermediate pressure steam turbine in accordance with one embodiment of the present invention.
Figure 3:
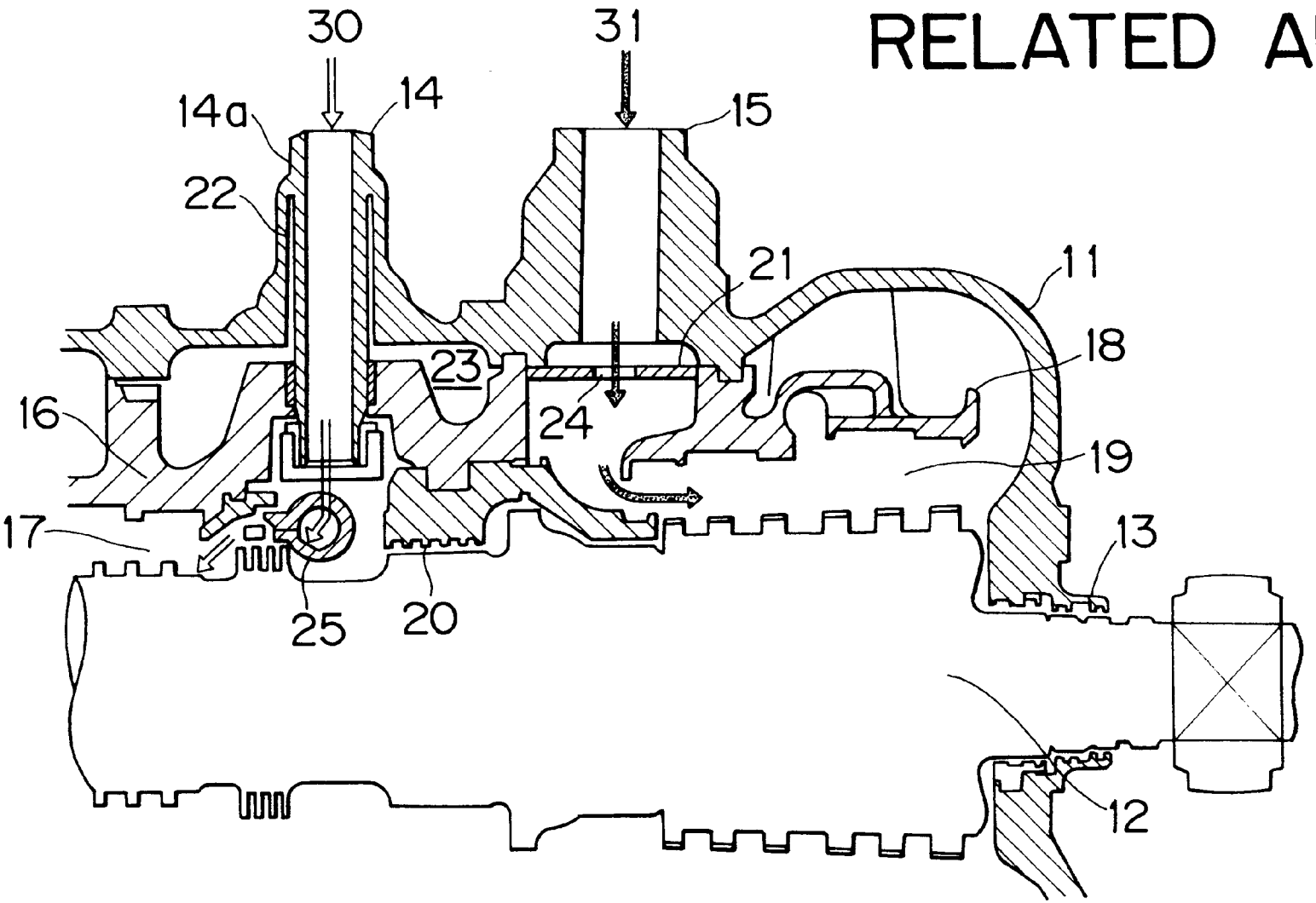
FIG. 3 RELATED ART
FIG. 3 is a sectional view showing the vicinity of an inlet tube for a high and intermediate pressure steam turbine relating to the present invention.

An embodiment of the present invention will now be described in detail with reference to the accompanying drawings. FIG. 1 is a sectional view of a flexible inlet tube for a high and intermediate pressure steam turbine in accordance with one embodiment of the present invention. In FIG. 1, elements denoted by reference numerals 11 to 14, 16 to 25, 30 and 31 are the same as the elements shown in FIG. 3, so that the detailed description of these elements is omitted, and these reference numerals are used in this embodiment. A construction portion characteristic of the present invention, which is denoted by reference numerals 1 to 8, will be described in detail.

In FIG. 1, reference numeral 1 denotes a reheat steam inlet tube, which is constructed integrally with the casing 11. Reference numeral 2 denotes a double tube portion formed in the inlet tube 1, which forms an annular groove 3 having a predetermined clearance between the double tube portion 2 and an inner peripheral surface of the inlet tube 1. Reference numeral 4 denotes an expanded diameter portion at the lower end of the double tube portion 2. A cylindrical flange 5, which is fixed to the thermal shield 21 by welding or other means, engages with an inside diameter portion of the expanded diameter portion 4 of the double tube portion 2 with a predetermined gap being held therebetween.

A seal ring 6, which is interposed in the gap at the engagement portion between the expanded diameter portion 4 and the flange 5 provided on the thermal shield 21, provides a seal therebetween and enables a vertical sliding motion when thermal elongation develops on the reheat steam inlet tube 1 and the flange 5 of the thermal shield 21.

In the reheat steam inlet tube 1 constructed as described above, the reheat steam 31 passes through the interior of the double tube portion 2, and a cavity is formed around the double tube portion 2 by the annular groove 3, so that heat is less liable to be transmitted because the double tube portion 2 is isolated from the wall surface integral with the surrounding casing 11. Also, as described later, the construction is such that steam having a temperature lower than that of the reheat steam 31 is introduced into the annular groove 3 of the double tube portion 2 so that the annular groove 3 of the double tube portion 2 is cooled by the circulation of steam.

Also, the construction is such that even if the double tube portion 2 is heated by the reheat steam 31 and thermal elongation develops, a vertical sliding motion occurs between the expanded diameter portion 4 at the lower end of the double tube portion 2 and the flange 5 of the thermal shield 21 via the seal ring 6, by which the thermal elongation is absorbed.

Figure 2:
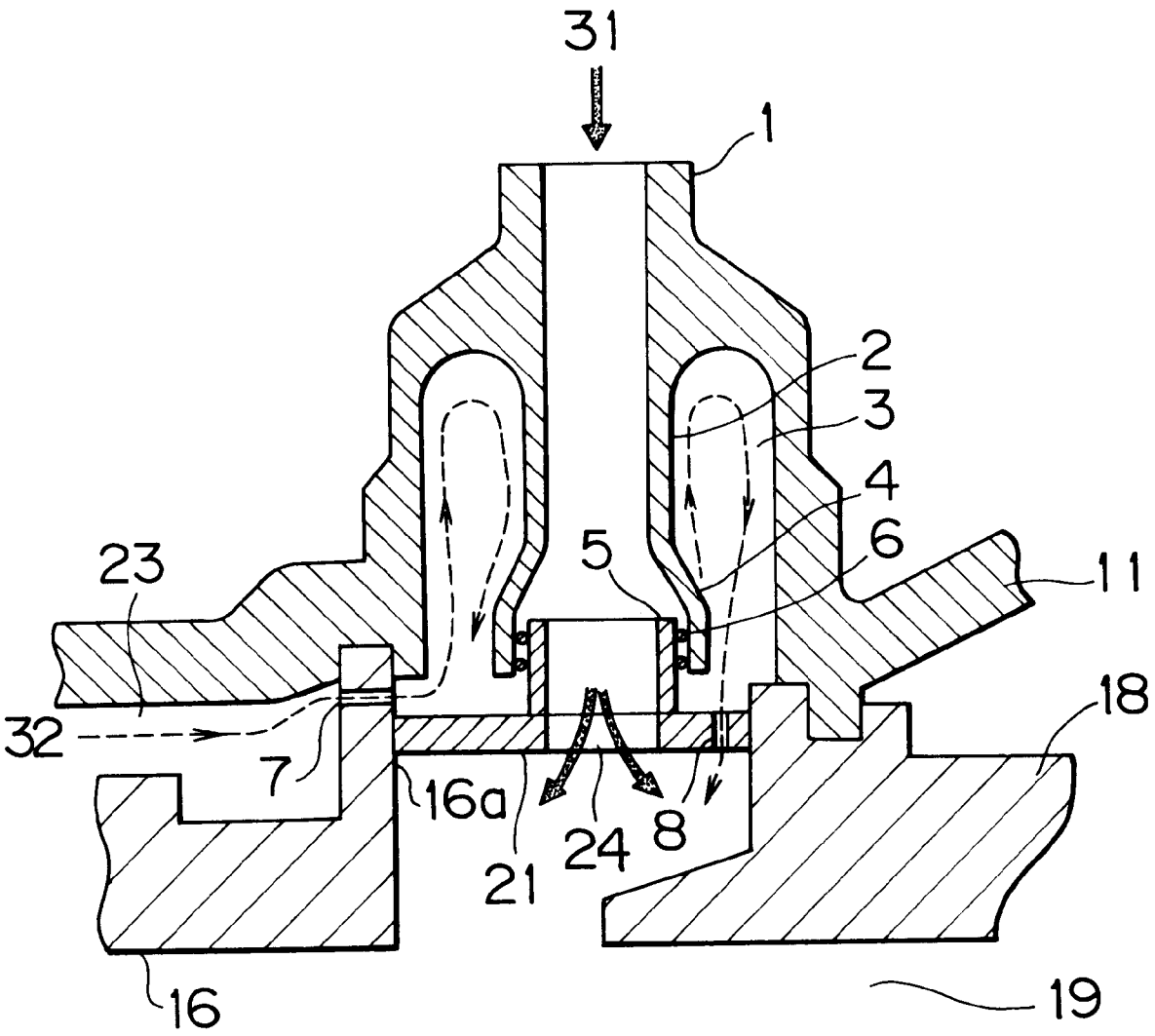
FIG. 2 is a sectional view showing a cooling construction of a flexible inlet tube for a high and intermediate pressure steam turbine in accordance with one embodiment of the present invention.

FIG. 2 is an enlarged view of the reheat steam inlet tube 1, showing a cooling construction of the reheat steam inlet tube 1. In this figure, the in-casing space 23 is formed between the high pressure turbine stationary portion 16 and the casing 11, and low-temperature low-pressure steam is introduced into this space 23 as described later.

A mounting flange **16*a* of the high pressure turbine stationary portion 16, which is fitted to the base portion of the reheat steam inlet tube 1, is formed with a hole 7 so that the space 23 and the annular groove 3 of the reheat steam inlet tube 1 communicate with each other. The annular groove 3 also communicates with the steam passage in the intermediate pressure turbine section 19 via a hole 8 formed in the thermal shield 21**.

In the above-described reheat steam inlet tube 1, the reheat steam 31 having a high temperature of about 600° C. is introduced into the reheat steam inlet tube 1. However, the double tube portion 2 is isolated from the peripheral wall surface of the inlet tube 1 constructed integrally with the casing 11 by the annular groove 3, so that heat is less liable to be transmitted to the surroundings. The high-temperature steam of about 600° C. flowing into the inlet tube 1 passes through the flange 5, and is introduced into the steam passage in the intermediate pressure turbine section 19 through the opening 24 of the thermal shield 21, by which the steam does work in the intermediate pressure turbine section 19.

Even if the double tube portion 2 is heated by the reheat steam 31 and is changed by thermal elongation, a vertical sliding motion can be accomplished between the expanded diameter portion 4 and the flange 5 of the thermal shield 21 via the seal ring 6. Therefore, the change of the double tube portion 2 is absorbed, and the seal ring 6 prevents the reheat steam from leaking into the annular groove 3.

On the other hand, low-temperature low-pressure steam having a temperature of about 380° C. and a pressure of about 42 kg/cm$^2$ is introduced into the in-casing space 23 provided between the casing 11 and the high pressure turbine stationary portion 16. This steam flows into the annular groove 3 of the reheat steam inlet tube 1 through the hole 7, circulates in the annular groove 3, and flows out to the steam passage in the intermediate pressure turbine section 19 through the hole 8. Then, this steam is combined with the reheat steam and is introduced to the steam passage to do work. This circulation of steam cools the double tube portion 2 and the peripheral wall surface of the inlet tube 1, and makes the heat from the reheat steam less liable to be transmitted to the surroundings.

As described above, according to the flexible inlet tube of this embodiment, there is provided a construction such that the double tube portion 2 is provided in the reheat steam inlet tube 1 to form the annular groove 3, and the expanded diameter portion 4 is provided at the lower end of the double tube portion 2, by which a vertical sliding motion can be accomplished between the expanded diameter portion 4 and the flange 5 provided on the thermal shield 21 via the seal ring 6 to absorb thermal elongation. Also, there is provided a construction such that low-temperature steam is circulated in the annular groove 3 to cool the interior of the annular groove 3. Therefore, the temperature rise of the integrally constructed casing 11 caused by high-temperature reheat steam can be prevented. For this reason, as the material for the casing 11, an inexpensive material such as 2(¼)Cr Mo steel can be used in place of a 12Cr material having a high strength.

What is claimed is:

1. A flexible reheat steam inlet tube for a high and intermediate pressure steam turbine for introducing reheat steam into an intermediate pressure turbine section in a casing of the turbine, the turbine including a thermal shield which has an opening for introducing the reheat steam and thermally shields a surrounding portion at a lower end of said reheat steam inlet tube from the steam in the casing, said reheat steam inlet tube comprising:

a double tube having an outer tube adapted to be fixed to the casing and an inner tube disposed within the outer tube such that an annular groove is defined between the outer tube and the inner tube and surrounds the inner tube of said reheat steam inlet tube;

a cylindrical member one end of which slidably overlaps with a lower end portion of the inner tube of said double tube, the cylindrical member being adapted to be fixed to said thermal shield in connection with the opening thereof; and a seal ring interposed between said cylindrical member and the lower end portion of the inner tube of said reheat steam inlet tube; and a steam passage communicating with said annular groove for supplying lower temperature steam into the annular groove for cooling the reheat steam inlet tube.

2. The flexible reheat steam inlet tube of claim 1, wherein the inner tube includes an expanded diameter portion at the lower end thereof, and the cylindrical member and seal ring are arranged to slidably engage the expanded diameter portion.

3. The flexible reheat steam inlet tube of claim 1, wherein the cylindrical member and seal ring are arranged to slidably engage an inner surface of the inner tube.

4. A steam turbine, comprising:

a casing;

a rotor passing axially through the casing;

a high-pressure turbine section supported on the rotor within the casing;

an intermediate-pressure turbine section supported on the rotor within the casing;

a main steam inlet tube passing through the casing for supplying main steam to the high-pressure turbine section;

a flexible reheat steam inlet tube passing through the casing for supplying reheat steam to the intermediate-pressure turbine section, the reheat steam inlet tube comprising a double tube including an outer tube fixed to the casing and an inner tube disposed within the outer tube such that an annular space is defined therebetween, the inner tube having a lower end;

a thermal shield mounted in the turbine for thermally shielding a surrounding base portion of the reheat steam inlet tube from the steam in the casing, the thermal shield defining an opening therethrough for introducing reheat steam into the intermediate-pressure turbine section; and a cylindrical member mounted on the thermal shield in connection with the opening thereof, the cylindrical member slidably and sealingly engaging the lower end of the inner tube of the reheat steam inlet tube, whereby reheat steam supplied through the inner tube flows through the cylindrical member and through the opening in the thermal shield into the intermediate-pressure turbine sections, wherein the high-pressure turbine section includes a high-pressure turbine stationary portion exposed to the annular space of the reheat steam inlet tube, a steam passage being defined between the casing and the high-pressure turbine stationary portion for carrying steam at a temperature lower than that of the reheat steam, and wherein the high-pressure turbine stationary portion defines a hole leading from said steam passage into the annular space of the reheat steam inlet tube for supplying lower-temperature steam into the annular space for cooling the reheat steam inlet tube.

5. The steam turbine of claim 4, further comprising a seal ring interposed between the inner tube and the cylindrical member.

6. The steam turbine of claim 4, wherein the thermal shield defines a hole therethrough in communication with the annular space of the reheat steam inlet tube for exhausting the steam therefrom after the steam has cooled the reheat steam inlet tube and supplying the steam to the intermediate-pressure turbine section.

* * * * *